United States Patent [19]

Erratico et al.

[11] Patent Number: 4,611,162

[45] Date of Patent: Sep. 9, 1986

[54] PARALLEL VOLTAGE REGULATORS WITH DIFFERENT OPERATING CHARACTERISTICS COLLECTIVELY FORMING A SINGLE REGULATOR WITH WIDE OPERATING RANGE

[75] Inventors: Pietro Erratico; Pietro Menniti, both of Milan, Italy

[73] Assignee: SGS-ATES Componenti Elettronici SpA, Agrate Brianza, Italy

[21] Appl. No.: 620,047

[22] Filed: Jun. 12, 1984

[30] Foreign Application Priority Data

Jun. 15, 1983 [IT] Italy ..... 21626 A/83

[51] Int. Cl.[4] ..... G05F 1/59

[52] U.S. Cl. ..... 323/269; 307/75; 323/303

[58] Field of Search ..... 323/303, 231, 269, 272, 323/268, 271, 299; 363/69, 71; 307/75, 82

[56] References Cited

U.S. PATENT DOCUMENTS

| | | | |
|---|---|---|---|
| 3,414,802 | 12/1968 | Harrigan et al. | 323/268 |
| 3,521,150 | 8/1970 | Bates | 323/272 |
| 4,017,779 | 4/1979 | McDonald et al. | 323/303 |
| 4,074,182 | 2/1978 | Weischedel | 323/269 |
| 4,543,522 | 9/1985 | Moreau | 323/303 |

FOREIGN PATENT DOCUMENTS

| | | | |
|---|---|---|---|
| 240764 | 8/1969 | U.S.S.R. | 323/269 |
| 451987 | 4/1975 | U.S.S.R. | 323/269 |
| 550626 | 5/1977 | U.S.S.R. | 323/269 |
| 725068 | 3/1980 | U.S.S.R. | 323/269 |
| 811233 | 3/1981 | U.S.S.R. | 323/269 |

OTHER PUBLICATIONS

Adrian Weiss, "Adjustable, Regulated, High Current D.C. Power Supply"; CQ, Apr. 1980; vol. 36, #4; pp. 30–38.

*Primary Examiner*—William H. Beha, Jr.
*Assistant Examiner*—Jeffrey Sterrett
*Attorney, Agent, or Firm*—Wenderoth, Lind & Ponack

[57] ABSTRACT

A monolithic integrated voltage regulator consists of a multiplicity of regulator circuits connected in parallel to one another. These circuits have different dropouts and the voltage established across each set of output terminals is held at a predetermined constant value by means of a regulator circuit having its feedback circuits connected thereto. The predetermined value of the voltage across one set of output terminals is deliberately selected to be more or less elevated according to whether the dropout of its associated regulator circuit is more or less elevated.

4 Claims, 3 Drawing Figures

PARALLEL VOLTAGE REGULATORS WITH DIFFERENT OPERATING CHARACTERISTICS COLLECTIVELY FORMING A SINGLE REGULATOR WITH WIDE OPERATING RANGE

BACKGROUND OF THE INVENTION

The present invention relates to voltage regulators, and more particularly, to monolithic integrated electronic voltage regulators that can be used in automobile-type applications.

Voltage regulators supply a voltage with a value or values that are well-defined and constant from an unregulated voltage source.

Therefore, they can advantageously be used as regulated power supplies for other devices and, according to the load connected thereto, they supply the necessary current so that the voltage supplied to the load remains constant at all times.

Presently, for reasons of compactness, ease of use and economy, in all fields of application there is a growing tendency toward the production of electronic IC voltage regulators.

As a rule, the voltage across the output terminals of such voltage regulators and their output currents are established by means of an internal regulator circuit which have feedback circuits connected to the output terminals and which are responsive to the instantaneous value of the output voltage and current.

The most commonly used IC voltage regulators are those with a well-defined, series-type, regulation in which the output voltage is adjusted to a constant value by means of a power transistor which is in series with the output and which has its base properly controlled so as to control its conduction as a function of the load.

The basic circuit diagram of such a voltage regulator with series-type regulation is shown in FIG. 1 of the drawings.

A bipolar NPN transistor $T_S$ has its collector and emitter respectively connected to an input terminal IN and an output terminal OUT. Its base is controlled by a differential amplifier A having its supply terminals connected between the input terminal IN and ground. The inverting input of the amplifier A is connected to the output terminal OUT through a resistor R1, and to ground through a resistor R2. The non-inverting input of the amplifier A is connected to a reference voltage $V_R$.

As is well known to those skilled in the art, a voltage is established between the output terminal OUT and ground whose level depends on the input voltage $V_{IN}$ and on the load connected to the output terminal OUT only as long as the voltage $V_{IN}$ does not exceed a predetermined threshold value which is typical of the circuit, above which there is instead established across the output a constant voltage $V_O$ whose value is independent either of the input voltage or of the load and depends only on the design of the circuit proper, in particular on the feedback factor $\beta = R_2/(R_1+R_2)$. In fact, apart from said threshold value, which determines the lower limit of the range for proper operation (and, thus, also for possible use) of the regulator, the regulator circuit operates constantly.

Any deviation of the output voltage from the predetermined value will cause, through the voltage divider R1–R2, a feedback at the inverting input of the differential amplifier A, which drives the transistor $T_S$ to such a level of conduction as to restore a voltage to the load with the predetermined value $V_O$.

It is desired to identify the operating range, or better still, the lower limit, of a voltage regulator by means of a parameter known in the art as "dropout", which is the difference between the minimum value of the input voltage $V_{IN}$ necessary for the proper operation of the regulator and the value of the constant voltage $V_O$ established at the regulator output.

The IC voltage regulators normally employed in automobile-type applications are of the above-noted type. However, they must meet very stringent conditions because of the operating conditions characterized either by significant variations in temperature and humidity or by considerable, and sometimes sudden, variations of the supply voltage delivered by the car battery.

Therefore, these regulators must exhibit characteristics of high reliability, accuracy and stability in a very wide operating range together with a very low dropout.

The deviation of the supply voltage normally delivered by the battery can vary from approximately 5.5 V to 6.5 V during a cold start, to approximately 24 V when a second battery is connected in series with the first battery so as to enable an automobile to start under all conditions in cold countries.

However, high voltage surges, both positive and negative, can appear on the power supply line, due to inductive effects (sparking coils, relays, etc.) which occur during turn-off transients. These surges that can reach up to 100 to 120 V due to the accidental detachment of the alternator cable from the battery (in this case, positive surges, with high energies).

In addition to the above mentioned characteristics, a voltage regulator for automobile-type applications must also have a very low power consumption for reasons of efficiency but, above all, for reduced heat dissipation.

The prior art IC voltage regulators are not capable of satisfying all of the conditions for automobile-type applications at the same time. As a matter of fact, properly operating voltage regulators, even for very low input voltages (having, therefore, a low dropout) have a considerable power consumption At this point, it should be borne in mind that in general, transistors such as $T_S$ depicted in FIG. 1, that are put into integrated circuits carry much higher voltages during turnoff than those carrying voltages during turn-on or when in the active zone.

On the other hand, the regulators that are better from the viewpoint of power consumption have an excessively high dropout for the cold start and are not suitable for proper operation at high voltages.

SUMMARY OF THE INVENTION

The major purpose of the present invention is to create a monolithic integrated voltage regulator having an appropriate operating range which is wider than that of regulators of known construction and which fully meets the operating conditions for automobile-type applications and whose power consumption, in the present state of the art, is the least attainable.

The above noted object may be effected by providing an integrated voltage regulator having first and second input terminals which are respectively connected to two poles of a voltage generator and having first and second output terminals between which is established a voltage which is adjusted to predetermined constant values, said regulator comprising: a plurality of voltage regulator means, each having first and second input terminals which are respectively electrically connected to said first and second input terminals of said regulator and each having first and second output terminals between which is established a constant voltage, said first and second output terminals of said regulator means being respectively connected to said first and second output terminals of said regulator, said regulator means being operable for voltages supplied to their input terminals having values included in predetermined value intervals, whose minimum values are different from one another, wherein a voltage established between output terminals of each of said regulator means is held by each one of said regulator means at a predetermined constant value by means of an internal regulator means having feedback elements connected to its output terminals, said predetermined constant value being different for each one of said regulator means.

BRIEF DESCRIPTION OF THE DRAWINGS

The invention will become more apparent from a consideration of the ensuing detailed description given solely by way of non-limitative example in conjunction with the accompanying drawings, in which.

DESCRIPTION OF THE PREFERRED EMBODIMENT

Figure 2:
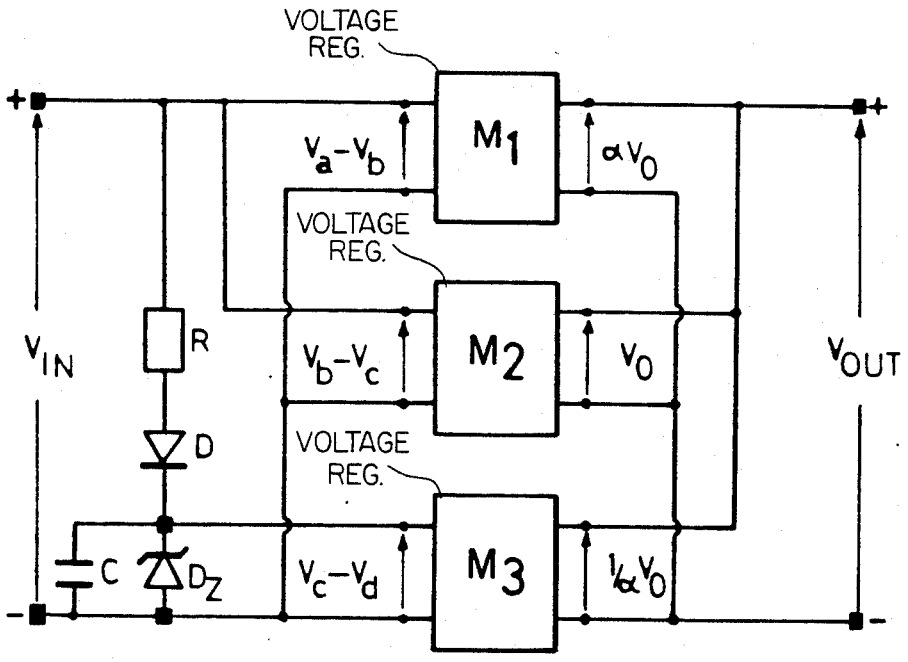
FIG. 2 is a diagram, partially in block form, of a voltage regulator for automobile-type applications in accordance with the present invention.

The voltage regulator in accordance with the present invention, as depicted in FIG. 2, comprises three different voltage regulator units shown in the figure by rectangular blocks respectively designated by the symbols $M_1$, $M_2$, and $M_3$, each having a first and a second input terminal and a first and second output terminal.

The voltage regulator has first and second input terminals respectively designated by the symbols "+" and "−", between which is established an unregulated voltage $V_{IN}$. The regulator has a first and second output terminals which are respectively designated by the symbols "+" and "−", between which is established a voltage $V_{OUT}$ having a predetermined constant value.

The first input terminal of regulator units of $M_1$ and $M_2$ are connected directly to the first input terminal of the regulator; the first input terminal of regulator unit $M_3$, on the other hand, is connected to the first input terminal of the regulator through a diode D and a resistor R which are connected in series.

The second input terminals of regulator units $M_1$, $M_2$, and $M_3$ are connected directly to the second input terminal of the regulator, to which is also connected a capacitor C and a Zener diode $D_Z$ which are connected in parallel. The other parallel connection of the capacitor C and diode $D_Z$ is connected to the first input terminal of regulator unit $M_3$.

The first output terminals of regulator units $M_1$, $M_2$, and $M_3$ are connected directly to the first output terminal of the regulator. The second output terminals of regulator units $M_1$, $M_2$, and $M_3$ are connected directly to the second output terminal of the regulator.

Figure 1:
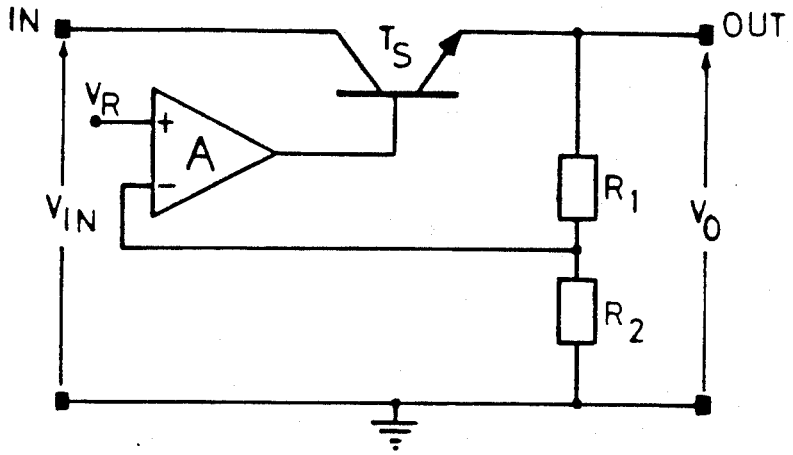
FIG. 1 PRIOR ART
FIG. 1 is a general diagram of a voltage regulator with series-type regulation such as described hereinabove.
Figure 3:
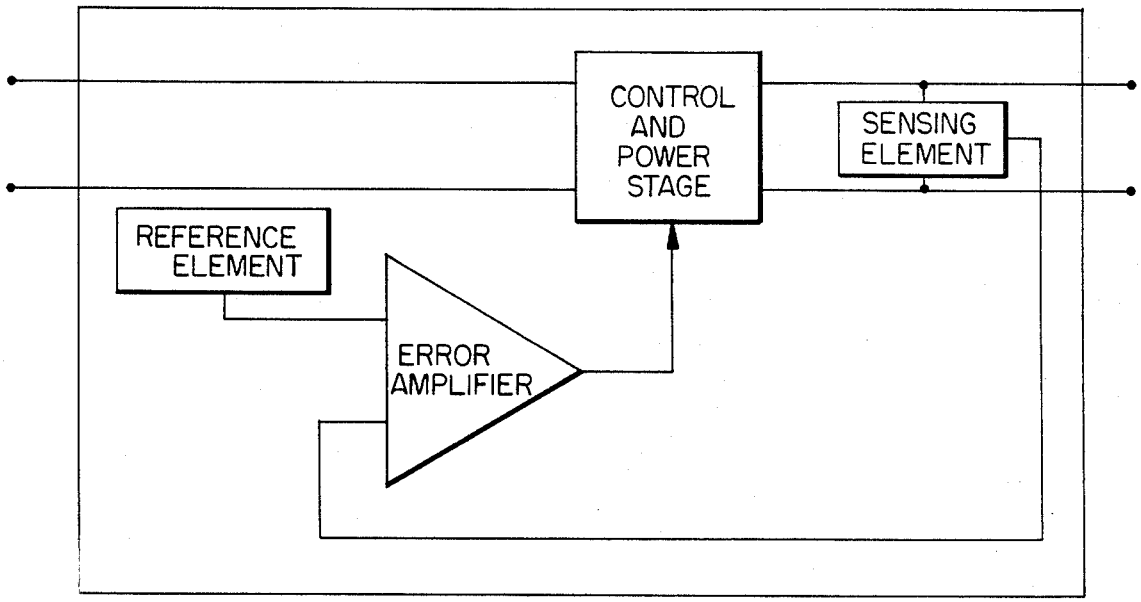
FIG. 3 is a block diagram of the voltage regulators $M_1$–$M_3$ shown in FIG. 2.

According to the present invention, the voltage regulator units represented by the blocks $M_1$, $M_2$, and $M_3$ are of the type in which the voltage across the output terminals and the output current are so established that the voltage has a constant and predetermined value by means of an internal regulator circuit having feedback circuits that are connected to the output terminals thereof and are responsive to the instantaneous value of the output voltage and current. Thus, regulator units $M_1$, $M_2$, and $M_3$ can be realized according to the prior art circuit diagram illustrated in FIG. 1. Also see FIG. 3 which illustrates a generalized block diagram of such a voltage regulator.

The values of the voltage across the input terminals which constitue the lower limits of the ranges for proper operation of the regulator units $M_1$, $M_2$, and $M_3$ (and, therefore, also the respective dropouts) are in an increasing progression.

According to the present invention, the essential feature for the operation of the voltage regulator is that the constant values of the voltages established between the output terminals of the regulator units $M_1$, $M_2$, and $M_3$ are in an increasing progression, although the differences between these values can be very small.

Denoted symbolically in FIG. 2 by $V_a$–$V_b$, $V_b$–$V_c$, and $V_c$–$V_d$ are the voltage value intervals across the input terminals forming the respective ranges for proper operation of the regulator units $M_1$, $M_2$, and $M_3$.

Similarly, designated by $\alpha$Vo, Vo and $1/\alpha$ Vo are the respective constant values of the voltages established between the output terminals of the regulator units.

The ranges for proper operation of the various regulator units must not necessarily extend with continuity and without superpositions, the only requirement being that with more regulator units one can cover the entire desired range for proper operation for the voltage regulator as a whole, and that each one of the regulator units within the required limits for proper operation, offers the best yield that can be attained.

The regulator units included in the voltage regulator can be of any number, provided there are at least two.

For a better understanding of the operation of a voltage regulator according to the present invention having any number of regulator units, let it be assumed that a voltage is applied to the input terminals having values which vary in an increasing progression.

Up to a predetermined threshold value, the regulator remains turned off; if this value is exceeded, a first regulator unit is turned on such that as soon as the value of the resulting voltage across its input terminals is within its required limits for proper operation, supplies to its output terminals and, thus, to the output terminals of the regulator, a constant voltage having a predetermined value. However, as soon as the rising voltage across the input terminals establishes a voltage across the input terminals of a second voltage regulator unit which has a value included within its required limits for proper operation, then a voltage with a predetermined constant value is also established at the output terminals of said second regulator unit which, according to the present invention, is greater than that established between the output terminals of the first regulator unit. The feedback circuits of the first regulator unit, connected to its output terminals and thus to the output terminals of the second regulator unit, detects a positive variation of the constant output voltage of the circuit and, accordingly, the regulator circuit of the first regulator unit, adjusts the conduction of its final power element to a lower level in order to compensate for said variation, as if the latter were caused by the load.

However, the second regulator unit detects said compensation and, in turn, compensates for the adjustment carried out by the first regulator unit, taking priority over the latter. The first regulator unit, sensing with its feedback circuits that the variation of the voltage across its own output terminals is still extant, then tends to compensate for it, and in a very short time, as can also be verified experimentally, has its final power element driven to the non-conducting state.

The voltage established between the output terminals of the voltage regulator thus remains adjusted to the appropriate predetermined constant value of the output voltage of the second regulator unit until the value of the voltage across the input terminals does not carry the voltage between the input terminals of a further regulator unit to a value included within the appropriate operating range of the further regulator unit which, in turn, causes the final power element of the preceding regulator unit to be cut off and to impose the appropriate constant value of the output voltage of the further regulator unit upon the output terminals.

In conclusion, following turn-on, for each value of the voltage applied to the input terminals of the voltage regulator, a single regulator unit included therein becomes operative. In fact, the regulator units having a lower dropout are automatically prevented from operating.

Thus, since they are turned off, the regulator units that are prevented from operating can carry the high voltages that reenter the operating range of other regulator units which are specifically suited to said high voltages.

The advantage resulting from automatically preventing the operation, without the use of any switching gear, of the regulator units that are not adapted to carry certain voltages is obvious: this advantage can be appraised in terms not only of cost for planning and useage of the integrated circuit area, but also in terms of improved reliability.

As emphasized above, very small differences between the constant values of the voltages established between the output terminals of the various regulator units are sufficient to enable the voltage regulator as a whole to operate.

The possible total variation of the value of the voltage across the output terminals can be set, for a voltage regulator for automobile-type applications in accordance with the present invention, within the tolerances normally allowed for the output voltage of a high-quality regulator. A typical value of $\alpha$ for said applications can be 0.995.

In a particular and advantageous realization of the diagram of FIG. 2 suitable for automobile-type applications, a voltage regulator unit with a low dropout can be used for $M_1$, which minimum can be attained with a transistorized integrated circuit, equal to the value of the collector-emitter voltage of a transistor (such as $T_S$) in saturation. Supposing that the desired output voltage is 5 V, as is normally required in such applications, proper operation can also be accomplished even when the battery voltage has a very low value, from 5.5 to 7.5 V, such as, for example, occurs during the cold start.

On the other hand, one can use a voltage regulator unit for $M_2$ with a higher dropout and with a limited operating range with input voltage values for normal operating conditions which, however, has the lowest power consumption that can presently be accomplished.

As an example, voltage regulator units with said characteristics are those with a final power stage of the Darlington type with dropouts equal to approximately twice the value of the base-emitter voltage of a transistor operating in an active zone plus the value of the collector-emitter voltage of a transistor in saturation, and with an operating range of from approximately 7.5 V to approximately 28 V.

Finally, one can use a voltage regulator unit for $M_3$ which is suitable for carrying higher voltages across the appropriate input terminals and can operate properly even for voltage surges up to 100 to 120 V across the input terminals of the regulator, so that not even for a moment is the regulated power supply for the electronic devices in use, including logic circuits, interrupted.

In this case, it is sufficient that the regulator unit operate for a likewise limited range of voltage values across its input terminals, but which are higher than that of the maximum voltage supplied by two batteries connected in series (about 28 V) under normal operating conditions, for which it is preferable that $M_2$ continue to operate.

The Zener diode $D_Z$, which can also be integrated monolithically, is so designed that the value of its threshold value $V_Z$ at reverse conduction is included within the operating range of $M_3$ (e.g., 30 V).

When the value of the voltage across the input terminals of the regulator exceeds that of the threshold voltage $V_Z$, the diode $D_Z$ becomes conductive, maintaining across its terminals and, therefore, also across the input terminals of $M_3$, said voltage value $V_Z$ which is independent of the voltage across the input terminals.

The resistor R serves to limit the level of the current flowing through the diodes D and $D_Z$ when the latter becomes operative.

On the other hand, the diode D is necessary in order to maintain $M_3$ in operation even during transients including negative voltage surges by means of the charge which has been stored in the capacitor C during the preceding normal operation. In fact, said diode prevents the discharge of the capacitor, through R, on the input terminal "+".

Since the capacitor C must have a relatively high capacity, it is usually designed as a discrete element, unlike R, D and $D_Z$ which, depending on the requirements, can be realized with either integrated or discrete elements.

While a single embodiment of the invention has been described and illustrated hereinabove, it is obvious that numerous modifications are possible without departing from the scope of the invention.

For example, one could include in the voltage regulator further regulator units that operate only in conformity with control by means of appropriate switching circuits.

We claim:

1. An integrated voltage regulator having first and second input terminals which are respectively connected to two poles of a voltage generator and having first and second output terminals, between which is established a voltage which is adjusted to predetermined constant values, said regulator comprising: a plurality of voltage regulator means, each having first and second input terminals which are respectively electrically connected to said first and second input terminals of said regulators, and each having first and second output terminals between which is established a constant voltage, said first and second output terminals of said regulator means being respectively connected to said first and second output terminals of said regulator, said regulator means being operable for voltages supplied to their input terminals having values included in predetermined value intervals, whose minimimum values are different from one another, wherein a voltage established between output terminals of each of said regulator means is held by each one of said regulator means at a predetermined constant value by means of an internal regulator means having feedback elements connected to its output terminals, said predetermined constant value being different for each one of said regulator means, wherein only one of said plurality of voltage regulator means is operative for any one value of input voltage to said regulator.

2. A voltage regulator as set forth in claim 1, wherein input terminals of a first and second regulator means of said plurality of regulator means are connected directly to said input terminals of said regulator, and first and second terminals of a third regulator means are respectively connected to said first input terminals of said regulator through a resistive element and a diode in series therewith, and to said second input terminal of said regulator, a Zener diode being connected across said input terminals of said third regulator means.

3. A voltage regulator as set forth in claim 2, wherein a capacitor is connected across said input terminals of said third regulator means.

4. A voltage regulator as set forth in claim 3, wherein said first and second regulator means regulate for respective voltages across therein input terminals having values in the ranges of approximately between 5.5 and 7.5 V and approximately between 7.5 and 28 V, and the value of a reverse conduction threshold voltage of said Zener diode and a minimum value of the voltage across said input terminals of said third regulator means are both approximately 30 V, and wherein each predetermined constant value of the voltage across the output terminals of each of said regulator means is lower than that of a regulator means having a next higher predetermined constant value by a factor equal to approximately 0.995.

* * * * *